United States Patent [19]

Saculla

[11] Patent Number: 4,548,217

[45] Date of Patent: Oct. 22, 1985

[54] COMBINED CIGARETTE EXTINGUISHER AND ASH TRAY

[76] Inventor: Frank W. Saculla, 3447 Glenmere Dr., Youngstown, Ohio 44511

[21] Appl. No.: 461,688

[22] Filed: Jan. 28, 1983

[51] Int. Cl.[4] ..... A24F 19/14

[52] U.S. Cl. ..... 131/235.1; 131/242; 131/256

[58] Field of Search ..... 131/231, 235 R, 256, 131/242, 241, 237, 238; D27/9

[56] References Cited

U.S. PATENT DOCUMENTS

| | | | |
|---|---|---|---|
| 1,588,043 | 6/1926 | Mower | 131/242 |
| 1,780,258 | 11/1930 | Weinberg | 131/235 R |
| 2,270,781 | 1/1942 | Friedman | 131/235 R |
| 2,657,090 | 10/1953 | Meek | 131/242 |
| 2,910,073 | 10/1959 | Lookholder | 131/235 R |
| 2,950,721 | 8/1960 | Aghnides | 131/235 R |
| 3,519,001 | 7/1970 | Bolinger | 131/235 R |

*Primary Examiner*—V. Millin

*Assistant Examiner*—H. Macey

[57] ABSTRACT

Herein disclosed is a compact, highly attractive combination cigarette extinguisher and ash tray. The device comprises a body portion of generally cylindrical formation adapted to be supported on a table top, desk or the like with its axis vertical. The peripheral wall of the body provides a plurality of vertically-extending recesses each adapted to receive a cigarette butt with the lighted end of the latter downward. A cap fits over the upper portion of the body and is rotatable to align an opening in the cap with a selected one of the vertically-extending recesses to permit deposit of a cigarette butt in such recess. The cap is then rotated to close off the recess and the light on the butt is quickly extinguished. A filter element is disposed between the upper surface of the body and the inner surface of the cap to restrict passage of the odor of the extinguished butt from passing into the room in which the combination cigarette extinguisher and ash tray is disposed.

10 Claims, 9 Drawing Figures

FIG. 5.
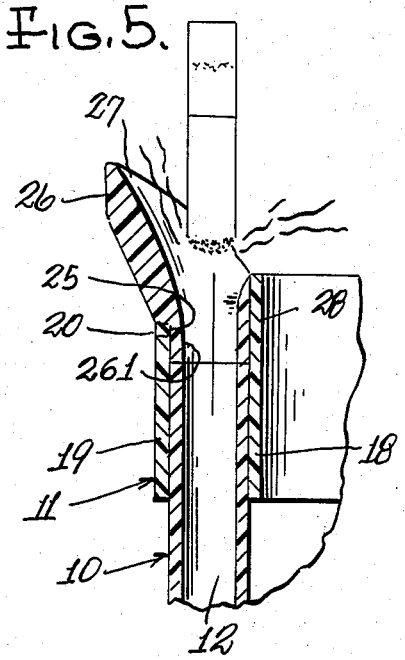
FIG. 6.
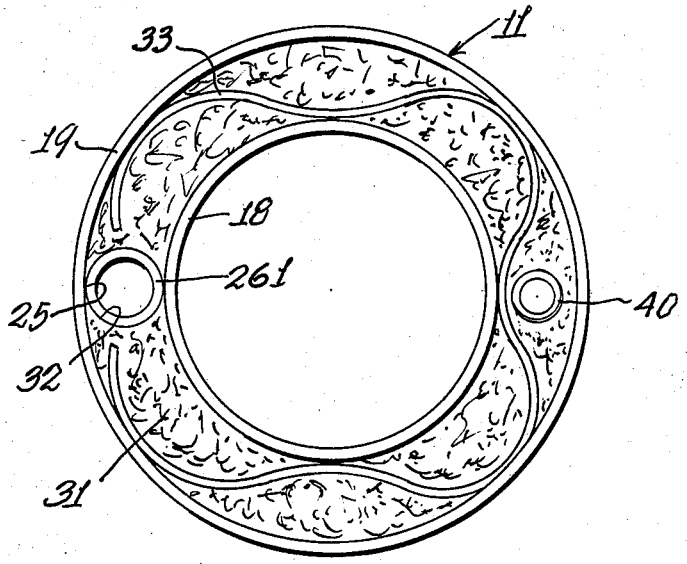
FIG. 7.
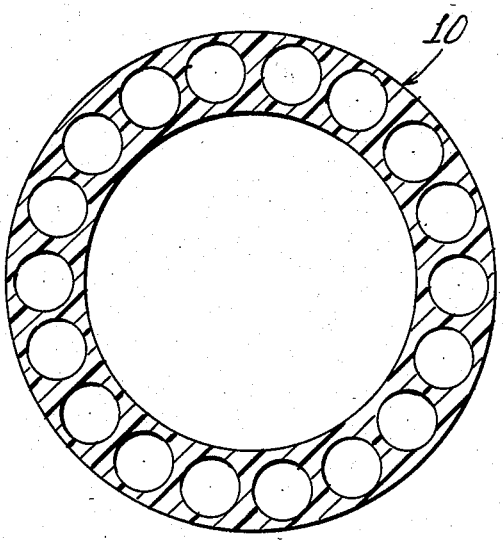
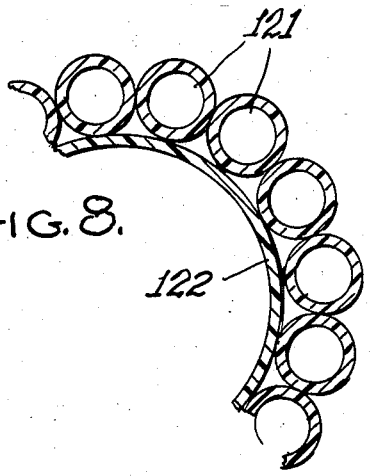
FIG. 8.
FIG. 9.
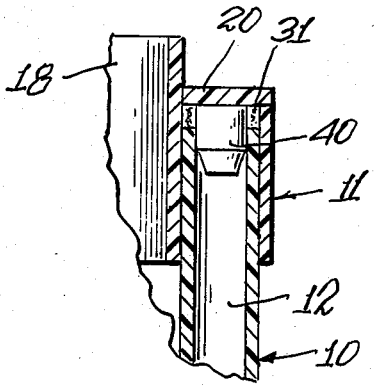

COMBINED CIGARETTE EXTINGUISHER AND ASH TRAY

BACKGROUND AND SUMMARY

Known in the prior art are cigarette extinguishers wherein a lighted cigarette butt is deposited in an elongated recess and the air supply to such recess thereafter cut off so as to extinguish the light on such butt. Various patents in the prior art show rotatably cylinders having a plurality of elongated recesses at the periphery thereof, each recess at a certain time being adapted to receive a cigarette butt. Ash trays combined with such extinguishers are also known.

My invention provides a combination cigarette extinguisher and ash tray that is highly efficient and yet is attractive enough for use in any room of a house.

The components of my improved device are preferably made of a plastic material of a type wherein color may be incorporated. The device comprises a cylindrical body adapted to be supported upright on a table top, desk or the like. A plurality of upright recesses are formed in the peripheral wall of the body, each recess opening at the top of the body. The recesses may be in part formed as upright flutes to give a fluted effect to the exterior of the body.

A cap fits over the upper end of the body and is adapted to rotate relative thereto. The cap has a single opening adapted to be registered with any one of the upright recesses to permit a lighted butt to be deposited therein. The cap is then rotated to close off the recess from a supply of air, wherepon the light in the butt is extinguished in a matter of seconds. The cap preferably has a guide member extending upwardly therefrom to provide a target to assist in guiding a cigarette butt through the opening in the cap. The cap also has a circular, upstanding perch having recesses to support a cigarette.

The cap and body may be made of different colored plastic for a very attractive appearance. The fluted exterior of the body lends to the attractiveness of the device. Although my improved device is highly efficient, it is relatively small in size. Further, the device will prevent the smell of stale cigarette butts from entering the room, since a filter element is disposed between the upper end of the body and the facing inner surface of the cap.

DESCRIPTION OF THE DRAWINGS

In the drawings accompanying this specification and forming a part of this application, there are shown embodiments of my invention and in these drawings:

FIG. 5 is a fragmentary sectional view corresponding to the line 5—5 of FIG. 2, FIG. 6 is a plan view of the cap looking into the interior thereof, FIG. 7 is a fragmentary sectional view showing another embodiment of my invention, FIG. 8 is a view similar to FIG. 3 but showing still another embodiment of my invention, and FIG. 9 is a fragmentary sectional view showing a form of indexing means.

DESCRIPTION OF THE PREFERRED EMBODIMENT

The improved device of my invention comprises two main parts, namely a body 10 and a cap 11, both made of plastic preferably with contrasting colors. The body is generally cylindrical and adapted to be disposed in upright position so that its bottom rests on a table top, desk or other surface.

A plurality of upright recesses 12 are formed along the outer periphery of the body, each of a transverse size to comfortably receive a cigarette butt disposed lengthwise in such recess. The recesses are in the form of round holes, the outer webs 14 of each forming a curved flute which extends vertically. The flutes form the outer periphery of the body 10 to provide a very attractive fluted appearance. The recesses provide wells of a length to accomodate the longest cigarette butt resulting from the long cigarettes on the market.

Figure 1:
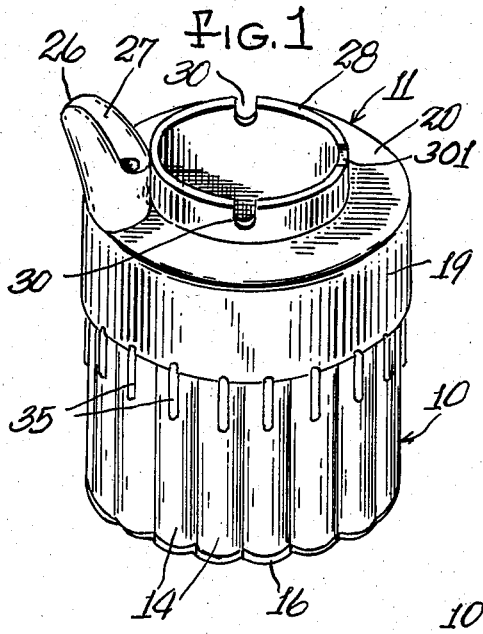
FIG. 1 is a perspective view of a presently-preferred embodiment of my invention.
Figure 2:
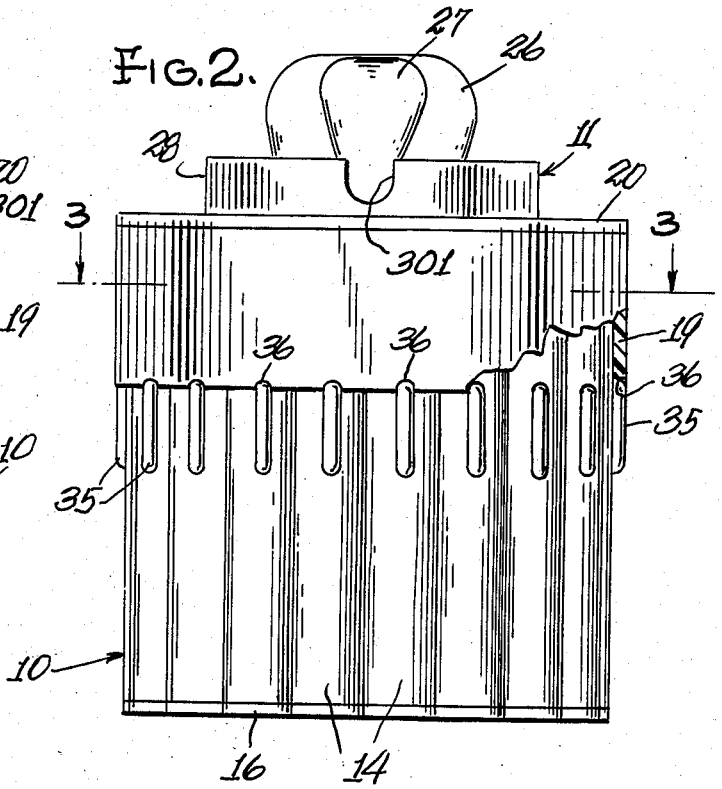
FIG. 2 is a side elevational view of the embodiment.
Figure 3:
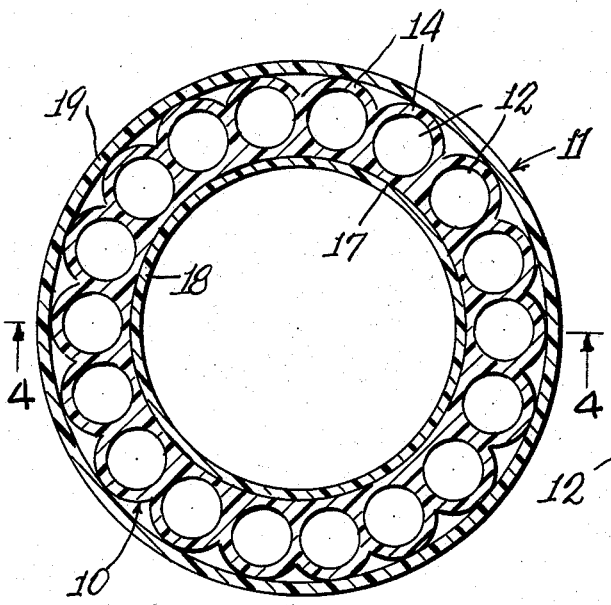
FIG. 3 is a transverse sectional view corresponding to the line 3—3 of FIG. 2.

The recesses open at the top surface 15 of the body and are closed at the base 16 of the body. The body and cap may be formed by an injection molding process, or the body may be an extrusion. In any event, it may sometimes be more economical to form the base 16 as a separate part, and cement it to the bottom of the body. As seen in FIG. 3, the inner peripheral surface 17 of the body is smooth and cylindrical. However, it is possible to form vertical flutes on such inner surface to correspond to the fluted exterior surfaces. Further, the body may be formed by cementing together a plurality of plastic tubes 121 which are arranged in a circular manner by themselves, or around a cylinder 121 as shown in FIG. 8. If the flutes are not desired, the body may be formed with smooth interior and exterior surfaces, as shown in FIG. 7.

The cap 11 comprises an inner circular wall 18 and an outer circular wall 19, joined by a top wall 20 and thereby held in spaced relation. As seen in FIG. 3, the inner wall 18 fits against the inner peripheral surface of the body, and the outer wall 19 fits around the outer periphery of the body. The cap 11 fits closely on the body, but may be rotated relative thereto. The cap may be formed as an integral unit by injection molding process, or the walls 18 and 19 may be separate items and cemented to the top wall 20.

Figure 4:
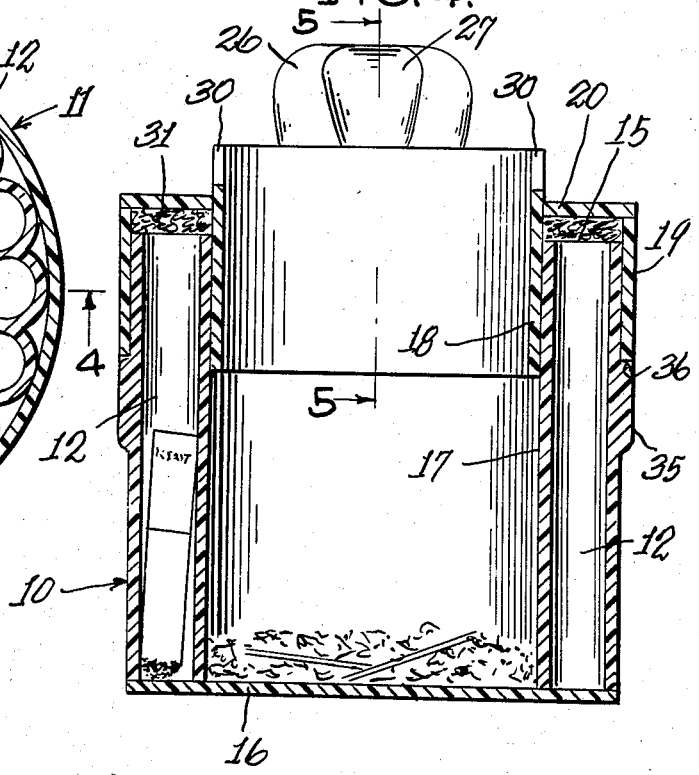
FIG. 4 is a longitudinal sectional view corresponding to the line 4—4 of FIG. 3.

As seen in FIG. 4, the inner surface of the top wall 20 of the cap overlies the top 15 of the body 10. The wall 20 is formed with a single opening 25 which is adapted to be aligned with a selected one of the recesses 12 to permit a cigarette butt to be disposed in such recess, as seen in FIG. 5. A target device 26 is cemented to the upper surface of the top wall 20 and has an enlarged opening 27 narrowing toward the single opening 25 and having a neck 261 fitting within said opening and extending therethrough. The target device assists in directing the lighted end of a cigarette butt through the opening 25 and to the selected recess 12.

The cap 11 has a circular wall 28 extending upwardly from the top wall 20, the wall 28 preferably being about the same diameter as the inner wall 18 and may form a continuation thereof. The upper margin of the wall 28 has diametrically opposed recesses 30—30 therein, and preferably a third recess 301 between the recesses 30. These recesses are of a size to receive and hold a cigarette that is disposed transversely of the wall 28.

In order to eliminate or minimize the stale odor of cigarette butts within the recesses, a filter element 31 is disposed between the upper end 15 of the body and the facing, inner wall of the top 20 of the cap. This filter may be ring-shaped to closely fit the transverse space defined by the cap walls 18 and 19, and may be formed of a fibrous material designed to entrap smoke and odors that would otherwise tend to seep from the recess opening, laterally and thence downwardly between the respective cover walls 18 and 19, and the body wall 17 and also the exterior periphery of the flutes and thence into the atmosphere. In this respect, the filter may be impregnated with a deodorizing material. As seen in FIG. 6, the filter has a single opening 32 through which the neck 261 of the target device 26 passes the lower end of the neck bearing against the body top surface so that the cigarette butt does not come in contact with the filter when it is shoved into a selected recesses 12. The filter may be removably held in place by a snap ring 33 (see FIG. 6) so that it may be replaced as needed.

As seen in FIG. 4, the center of the body 10 is open to correspond with the central opening formed by the cap wall 28, so that ashes, matches and the like may be deposited therein.

Indexing means are provided to insure that the hole 25 in the cap wall 20 is axially aligned with a selected one of the recesses 12. In the present embodiment, such means comprises an upright rib 35 formed on each of the webs 14. The lower margin of the outer wall 19 of the cap has spaced notches 36 of a number equal to the ribs 35, the upper end of each rib seating within a respective notch. To index the cap, it is lifted to unseat the ribs from the notches, then rotated while applying a slight downward pressure to seat the ribs in the notches in the indexed position. In some cases only notch 36 may be formed on the cap wall 19 to cooperate with a selected one of the ribs 35. Or, if preferred, only one rib 35 may be provided to cooperate with a selected one of the notches 36.

Another form of indexing means is shown in FIGS. 6 and 9 wherein a peg 40 extends downward from the lower surface of the cap top wall 20 to fit into a selected one of the recesses 12. The peg is shown in elevation in FIG. 9 for clarity purposes. Preferably, the peg 40 is disposed diametrically opposite the target device 26, as shown in FIG. 6, and has a tapered lower end to facilitate seating in a selected recess. In this form of indexing means, the ribs 35 and notches 36 may be eliminated.

It will be appreciated that the invention hereinbefore disclosed may be adapted for use with cigars merely by a change in size to accommodate cigars. Thus, it will be appreciated that the term cigarette as used herein and in the claims should be interpreted broadly enough to include cigars.

I claim:

1. A cigarette butt receiver, comprising a cylindrical body of rigid material, adapted to have its bottom resting on a table top and the like to support said body with its longitudinal axis upright, said body having means defining a plurality of individual elongated parallel recesses spaced apart along a circle adjacent to and outwardly of its cylindrical periphery, each recess means providing a well to receive and enclose a cigarette butt disposed lengthwise therein and each well being of a transverse size to comfortably receive a lengthwise disposed cigarette butt, each of said wells being closed at said body bottom and each having an upwardly facing opening at the top of said body, a cover having an annular trasversely-disposed top wall overlying said body top and said plurality of recess openings, and a circular skirt wall depending from said top wall, said skirt wall closely surrounding the said circular plurality of recess means, said top wall having an opening therethrough in the portion thereof overlying said recess openings, means mounting said cover for rotatable movement relative to said body whereby said cover opening may be aligned with a selected one of said recesses to permit a cigarette butt to be moved lengthwise through said cover and recess openings for deposition in the recess well, rotation of said cover to misalign its opening with the selected recess well containing the cigarette butt causing restriction of air supply to such recess well by said top wall to cause early extinguishment of the lighted end of such butt.

2. The cigarette butt receiver of claim 1 and further including indexing means in part on said body and in part on said cover, said indexing means being cooperable to insure axial alignment of said cover opening with any one of said recesses.

3. The cigarette butt receiver of claim 1 wherein the plurality of recess means on said body have a plurality of vertically-extending flutes circularly spaced apart along the periphery of said plurality of recess means.

4. The cigarette butt receiver of claim 3 wherein said flutes are in the same number as said recesses, each flute being formed by a defining wall of a recess.

5. The construction according to claim 4 and further including indexing means to insure axial alignment of said cover opening with any one of said recesses, said indexing means comprising an abutment on a flute and a recess in said cover in which said abutment is removably seated.

6. The construction according to claim 1 and further including indexing means to insure axial alignment of said cover opening with any one of said recesses, said indexing means comprising a peg extending downwardly from said cover top wall and adapted to seat within a selected recess, whereby said cover must be raised relative to said body to withdraw said peg from the recess to permit rotation of said cover.

7. The cigarette butt receiver of claim 1 and further including annular filter means carried by said cover top wall and disposed between said body top and the inner surface of the top wall of said cover, said filter means thereby covering the open end of said recess wells closed by said top wall to contain smoke and odor of a butt within a well.

8. The cigarette butt receiver of claim 1 and further including a target device carried by said cover and extending upwardly from said cover top wall in alignment with the opening in said wall, said target device having an enlarged opening tapering to said cover opening to assist in directing the lighted end of a cigarette butt into a recess well which is aligned with said cover opening.

9. The cigarette butt receiver of claim 7 wherein said filter means is removably held within said cover.

10. The cigarette butt receiver of claim 1 wherein said cover has a central opening aligned with a central opening in said body, the latter opening providing a well for receiving ashes, matches and other refuse.

* * * * *